US008430604B2

(12) United States Patent
Onsori

(10) Patent No.: US 8,430,604 B2
(45) Date of Patent: Apr. 30, 2013

(54) SHIELD SUPPORT ASSEMBLY FOR UNDERGROUND MINING AND SUPPORTING SURFACE ELEMENT THEREFOR

(75) Inventor: Siamak Onsori, Dortmund (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 319 days.

(21) Appl. No.: 12/999,602

(22) PCT Filed: Jun. 16, 2009

(86) PCT No.: PCT/IB2009/052558

§ 371 (c)(1),
(2), (4) Date: Dec. 16, 2010

(87) PCT Pub. No.: WO2009/153734

PCT Pub. Date: Dec. 23, 2009

(65) Prior Publication Data

US 2011/0097158 A1 Apr. 28, 2011

(30) Foreign Application Priority Data

Jun. 20, 2008 (DE) ..... 10 2008 029 014

(51) Int. Cl.
*E02D 5/00* (2006.01)

(52) U.S. Cl.
USPC ..... 405/295; 405/294

(58) Field of Classification Search ..... 405/288–296
See application file for complete search history.

(56) References Cited

U.S. PATENT DOCUMENTS

| | | | | |
|---|---|---|---|---|
| 3,383,866 A | | 5/1968 | Groetschel | |
| 3,399,927 A | | 9/1968 | Groetschel | |
| 3,872,678 A | | 3/1975 | Shuttleworth | |
| 3,949,563 A | * | 4/1976 | Wertelewski et al. | 405/296 |
| 4,386,878 A | * | 6/1983 | Martinko et al. | 405/291 |
| 4,573,828 A | | 3/1986 | Jones et al. | |
| 4,784,532 A | * | 11/1988 | Prescott | 405/296 |

FOREIGN PATENT DOCUMENTS

| | | |
|---|---|---|
| DE | 198 14 246 A1 | 10/1999 |
| GB | 773407 A | 4/1957 |

* cited by examiner

*Primary Examiner* — Tara M Pinnock
(74) *Attorney, Agent, or Firm* — Foley & Lardner LLP

(57) ABSTRACT

A shield support assembly for underground mining includes a shield canopy and at least one floor runner as supporting surface elements. The shield canopy and at least one runner are connected in an articulated manner and can be pressed against rock at least one hydraulic cylinder which is supported in bearing pans on the shield canopy and floor runner. Each surface supporting element includes a welded construction of welded-together components. In order to be able to support higher forces without increasing the overall weight, at least one of the supporting surface elements includes at least one hollow metal box profile filled with a solid as a component of the welded construction.

20 Claims, 4 Drawing Sheets

SHIELD SUPPORT ASSEMBLY FOR UNDERGROUND MINING AND SUPPORTING SURFACE ELEMENT THEREFOR

This application claims priority to and the benefit of the filing date of International Application No. PCT/IB2009/052558, filed 16 Jun. 2009, which application claims priority to and the benefit of the filing date of German Application No. 10 2008 029 014.9, filed 20 Jun. 2008, both of which are hereby incorporated by reference into the specification of this application.

BACKGROUND

The present invention relates to a shield support assembly for underground mining. The shield support assembly includes a shield canopy and at least one floor runner as supporting surface elements. The shield assembly and at least one floor runner are connected in an articulated manner via a link mechanism and can be pressed against surrounding rock of a chamber to be kept open by means of at least one hydraulic cylinder which is supported in bearing pans on the shield canopy and floor runner. Each supporting surface element includes a welded construction of welded-together components. The present invention also relates to a supporting surface element such as a floor runner or a shield canopy for a shield support assembly for underground mining. The supporting surface element includes a welded construction of welded-together components and at least one bearing pan for supporting a hydraulic cylinder which can be pressed against another supporting surface element.

Shield support assemblies which can be adjusted in their height by means of hydraulic cylinders have been used in underground mining for decades and generally comprise two floor runners, a link mechanism, a goaf shield and a one-part or multi-part shield canopy which is connected in an articulated manner to the goaf shield. The shield canopy is pressed against the so-called hanging wall or roof, i.e. the overlying rock of an underground working face, by extending the usually two, sometimes also four, hydraulic cylinders so that a chamber, usually referred to as a stope, can be kept free within the underground rock for the purpose of arranging the winning machines. A plurality of height-adjustable shield support assemblies form an advancing support which can be moved forward or can push forward a winning machine by means of retracting the hydraulic cylinders and advancing individual shield support assemblies using substantially horizontally oriented advancing cylinders which are supported on the winning machine.

To achieve economic mining there is regularly a demand for shield support assemblies having a larger supporting surface which must be able to absorb correspondingly higher forces. The present invention provides a shield support assembly and also a shield canopy and/or a floor runner as a supporting surface element for such a shield support assembly which meet these requirements.

BRIEF DESCRIPTION

To achieve this and further objects, provision is made according to the present invention for at least one component of the welded construction of one or both supporting surface elements to comprise a hollow metal box profile filled with a solid. The use of hollow metal box profiles which are being filled with a solid makes it possible for the forces applied to the supporting surface elements by the rock or the hydraulic cylinders to be distributed in a particularly advantageous manner to the respective surface which is to be supported or which provides support, i.e. to the roof or floor. Solid-filled construction parts allow a uniform distribution of all the forces over the underside or upper side of the hollow metal box profiles. Filling the cavity of the hollow metal box profiles with a solid ensures at the same time that significantly higher compressive forces and also bending forces can be supported without the weight of the welded construction or of the supporting surface element increasing, since the wall thicknesses which suffice for the hollow metal box profile are considerably smaller than those required in the case of the hitherto used hollow profile elements for reinforcing the floor runners or the shield canopy. Reducing the metal weight and metal content simultaneously leads to a significant reduction in the manufacturing costs for the shield support assembly or of the shield canopy and/or floor runner, although higher surface loads can be supported.

In one particularly exemplary embodiment, the hollow metal box profile has a substantially rectangular cross section whose cavity is filled with the solid. The hollow metal box profiles used according to the present invention can consist of material sold by the meter and then be acquired in a cost-effective manner. According to one possible exemplary embodiment, the solid may consist of loose sand, loose granules or another loose, non-bound bulk material. When loose material is used, it should be possible to close the hollow metal box profile by means of closure caps, in which case a compensation possibility and/or refill possibility is advantageously provided in order to avoid voids within the hollow metal box profiles filled with loose solid. One compensation possibility can be achieved, for example, by means of closure caps which can be braced with respect to one another, or the like.

According to another exemplary embodiment, the solid consists of concrete, a mineral casting or of bulk material which is bound by means of binders, such as sand, gravel, steel fibres, a sintered material, etc. The greatest economic advantages are provided by the use of a suitable concrete as the solid, since a concrete can be produced cost-effectively, since concrete makes it possible to support high compressive forces, and since it can be ensured at the same time that the cavity of the hollow box profile can be completely filled with the concrete substantially without air inclusions.

According to another exemplary aspect, connection joints for the link mechanism, bearing pans and/or transverse struts for reinforcing the supporting surface elements of the shield support assemblies can be (only) welded onto the welded constructions or the hollow metal box profiles. The use of hollow metal box profiles which are filled with a bound solid, such as, in particular, concrete, offers the further advantage that connection joints for the link mechanism, the socket-like bearing pans for the hydraulic cylinders and/or the transverse struts can in addition be partially anchored in a positive and integrally bonded manner in the bound solid within the hollow metal box profile. To achieve the anchoring, it is possible in particular for at least one projecting, undercut anchor to be formed on the connection joints and/or on the bearing pans, wherein this anchor is inserted through an aperture in a profile wall of the hollow metal box profile into the cavity and is embedded fixedly against movement in the solid. In order to ensure positional stability, the connection joints or bearing pans can be anchored to the hollow metal box profile in an integrally bonded manner, for example fixed by means of weld spots prior to the introduction of the curing or setting solid, it then being the case that in permanent operation the corresponding weld spots are not exposed to alternating loads or at any rate to considerably smaller alternating loads than in the case of a purely welded connection. It can be advantageous if a reinforcement comprising reinforcing bars, reinforcing cables, reinforcing fibres or reinforcing meshes is provided in the solid. This simultaneously offers the possibility of connecting the anchors, for example at the bearing pans, directly to the reinforcement. The anchors here can optionally be screwed to the reinforcement or welded to the reinforcement, or the anchors have at least one through opening for the reinforcement.

According to one exemplary embodiment, the supporting surface element can be designed as a floor runner, it then being advantageous if the hollow metal box profile forms the bottom supporting surface by way of its underside which rests on the floor during operational use. The width of the hollow metal box profile therefore corresponds to the width of the floor runner and simultaneously determines the overall bearing surface of each floor runner. According to an advantageous embodiment, the hollow metal box profile can then be provided at its upper side with a through hole for the passage of an anchor formed at an underside of a joint socket which forms the bearing pan. It can be further advantageous if component assemblies having joint eyes for the link mechanism, in particular for lemniscate links, are welded to the outer sides of the hollow metal box profile. Therefore, a finished floor runner then consists of the hollow metal box profile filled with concrete or some other solid, this profile extending virtually over the entire length of a floor runner, wherein the metal outer walls of the hollow metal box profile simultaneously serve for welding on the functional component assemblies. As an alternative, or in addition, at least one of the supporting surface elements can consist of a multi-part composite element comprising a plurality of solid-filled hollow metal box profiles. Thus, for example, a floor runner can also be formed with a plurality of concrete-filled hollow metal box profiles which are then in turn anchored to form a floor runner. The anchoring can occur by means of weld seams or else via other connecting elements.

The use of a plurality of hollow metal box profiles can be advantageous in the creation or manufacture of a supporting surface element forming a shield canopy, since a shield canopy bears against the overlying rock at a surface which, for example, amounts to six times the bearing surface of all the floor runners of the same shield support assembly. The components filled with solid can advantageously form the longitudinal struts of the supporting surface elements which are subjected to bending stress. It can be advantageous in a shield support assembly if at least one, preferably two, solid-filled hollow metal box profiles constituting a central flange is or are welded on centrally below a canopy plate. Here, the cross section of the hollow metal box profiles forming the central flange can be selected to be considerably smaller than that of the hollow metal box profiles which directly form the floor runners. At least one further hollow metal box profile, which is again filled with solid, constituting a lateral flange is expediently welded on below the canopy plate on both sides of the central flange. However, the lateral flanges could also consist of other supporting profiles or the like. In shield canopies, too, the bearing pans can be positively anchored in the filling material for the hollow metal box profiles by virtue of the bearing pans for accommodating the heads of the hydraulic cylinders having lateral anchors which engage through passage openings in the side walls of the central flange and/or through passage openings in the side walls of the lateral flange into the cavity of the hollow metal box profiles which form these flanges and are there embedded in the solid.

According to another exemplary embodiment, the central flange extends only over a rear length section of the shield canopy or the shield plate, in which case a separate supporting profile can be welded on below the front length section of the canopy plate. It can be advantageous if this supporting profile has a foot part which is inserted, if appropriate by way of a base portion, into the hollow metal box profile and is anchored in the solid. If appropriate, metal struts or the like may be arranged as reinforcement on the foot part in order to achieve additional support for the supporting profile on the solid-filled hollow metal box profile. Such a construction makes it possible for shield canopies which project freely over large lengths to be supported securely against bending.

With further preference, hollow metal box elements can be arranged in front of and/or behind the bearing pans. Supporting profiles can then be inserted by way of a foot part into the hollow metal box elements arranged in front of the joint pans, with it again also being possible for these box elements to be filled with concrete. All the supporting profiles could comprise one or more profile flanges with, for example, a substantially T-profile in order to achieve a high bending strength for the shield canopy while using minimum material. According to another aspect, connecting pieces or bearing brackets having joint eyes for the link mechanism can be fastened to the rear ends of the rear hollow metal box elements. The connecting pieces also have a foot part which is inserted into the cavity of the respective hollow metal box element and (also) positively anchored there.

Further advantages and refinements of a shield support assembly according to the present invention comprising a shield canopy and a floor runner having at least one concrete-filled component will become apparent from the description given below of an exemplary embodiment which is shown schematically in the drawings.

DETAILED DESCRIPTION

Figure 1:
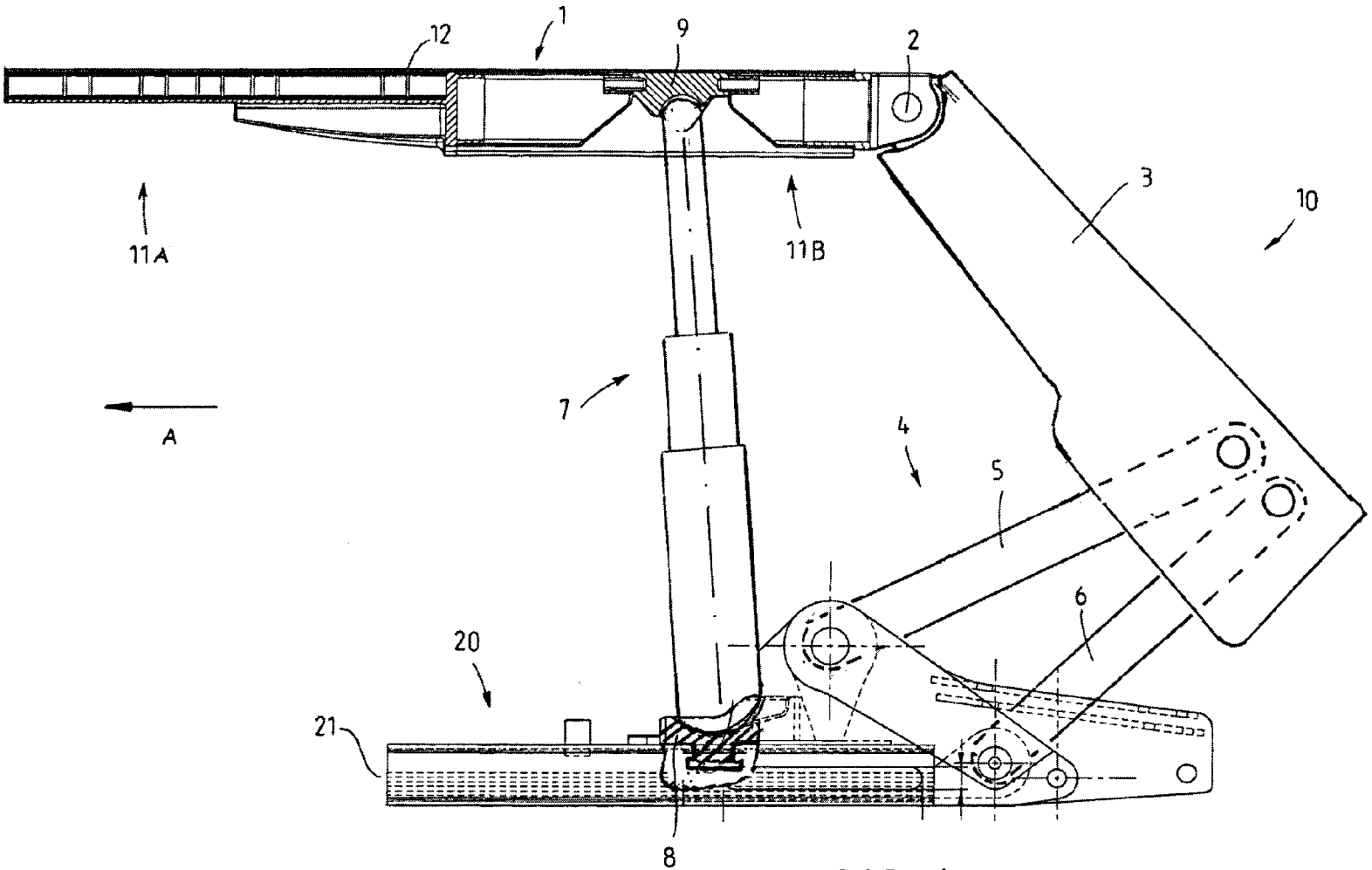
FIG. 1 is a side view, partially cut away, showing a shield support assembly according to the present invention in schematically highly simplified form.

Referring now to the drawings wherein the showings are for the purpose of illustrating exemplary embodiments of the present invention only and not for the purpose of limiting same, FIG. 1 shows an advancing support or a shield support assembly 10 for underground mining. The shield support assembly 10 comprises a shield canopy 1, a goaf shield 3 connected in an articulated manner to the shield canopy 1 at a canopy joint 2, a lemniscate mechanism 4 comprising a plurality of links 5, 6, and two floor runners 20, wherein a telescopically extendable hydraulic cylinder 7 is in each case arranged between each floor runner 20 and the shield canopy 1. An underground chamber for extracting mineral rock, such as, for example, coal, ore or the like, can be kept open by pressing the shield canopy 1 and the goaf shield 3 against the surrounding rock. Here, the shield support assembly 10 stands in a known manner on the so-called footwall or floor, i.e. the bottom of the underground chamber to be mined, by way of the two floor runners 20, of which only one can be seen in FIG. 1. The articulated connection between the floor runners 20 and the shield canopy 1 via the link mechanism 4 and the goaf shield 3 ensures that a height-variable underground chamber can be kept open with the same shield support assembly 10. The shield canopy 1 has its front shield region 11A projecting relatively far beyond the tip 21 of the floor runners 20 so that a winning machine for extracting the minerals can be positioned in a protected region below the shield canopy 1 and in front of the floor runners 20. In underground application, use is made of a plurality of identically designed shield support assemblies 10 which can all be used alongside one another and which, by means of an advancing operation performed in turn, can move or advance independently along the progressing mining course in the mining direction A. Since the entire rock load presses onto the upper side of the shield canopy 1, which upper side is here formed by a one-piece canopy plate 12, the hydraulic cylinder 7 is supported at its two ends via respective socket-like bearing pans 8 on the floor runner 20 and bearing pans 9 on the underside of the shield canopy 1. The width of the shield canopy 1 substantially determines the basic surface which can be kept open by a shield support assembly 10 and, in the case of the currently known shield support assemblies, this width is usually between 1.50 and 2.50 meters with an overall length of the shield canopy of approximately 3.50 meters to 5.00 meters. Since the floor runners rest on the bottom (floor) of the rock and the shield canopy 1 is pressed against the top (the roof), both the floor runner 20 and the shield canopy 1 each form supporting surface elements within the context of the present invention, and the text which follows will first explain the structure according to the invention of the floor runners with additional reference to FIGS. 2 to 4 and then the structure of the shield canopy with additional reference to FIGS. 5 to 8.

Figure 2:
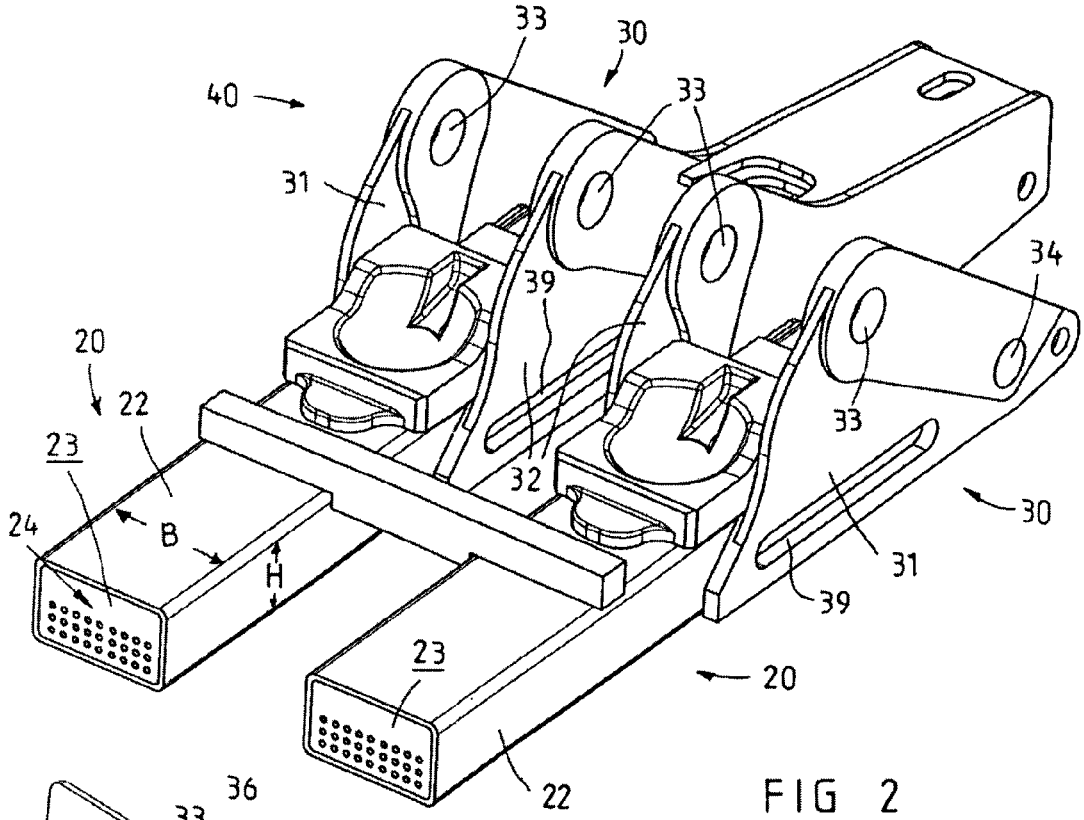
FIG. 2 is a perspective representation showing the lower part of the shield support assembly from FIG. 1 with two floor runners according to the present invention as supporting surface elements.
Figure 3:
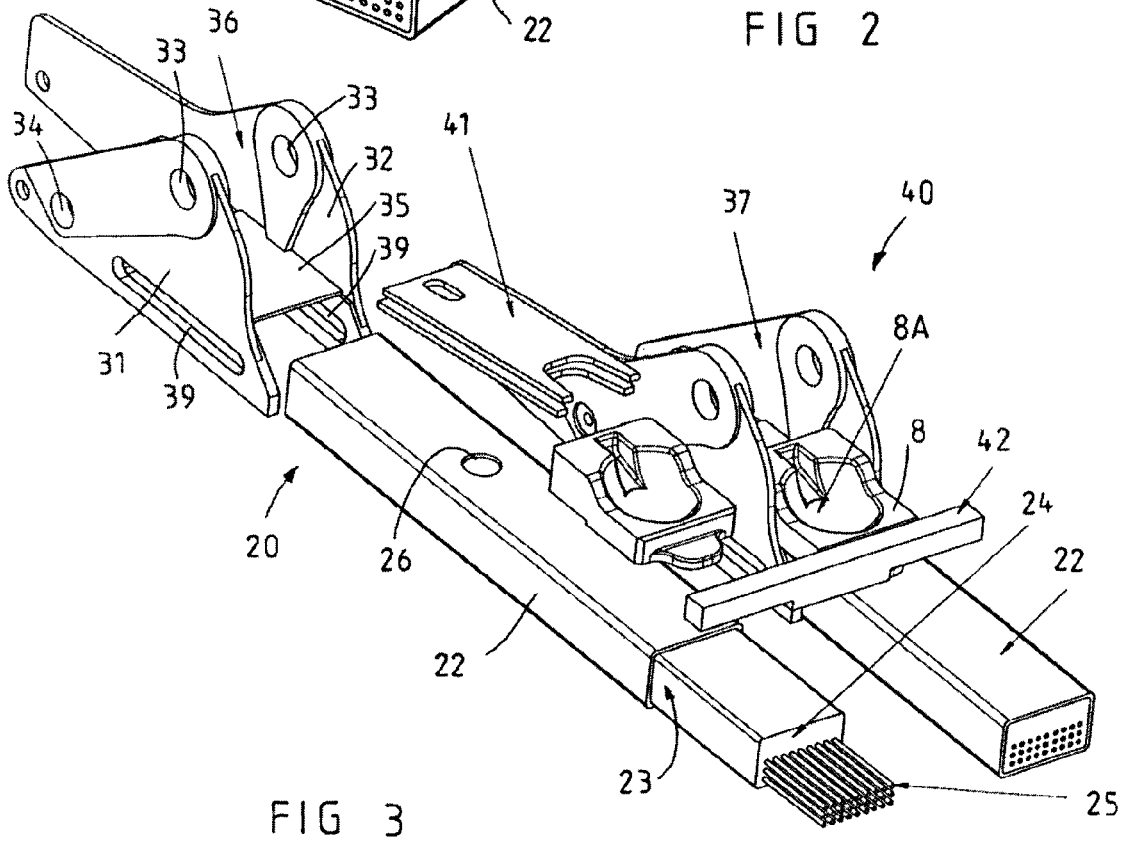
FIG. 3 shows the lower structure from FIG. 2 in another perspective view, partially in an exploded representation.
Figure 4:
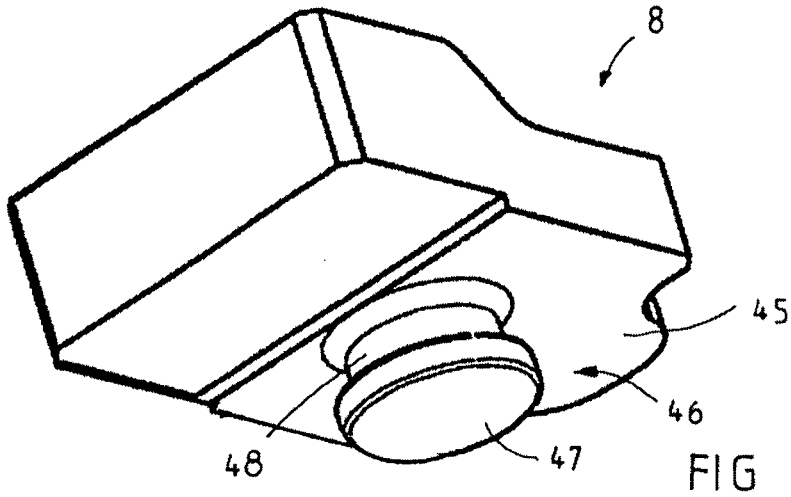
FIG. 4 shows in perspective a bearing pan with anchor for the floor runner.
Figure 7:
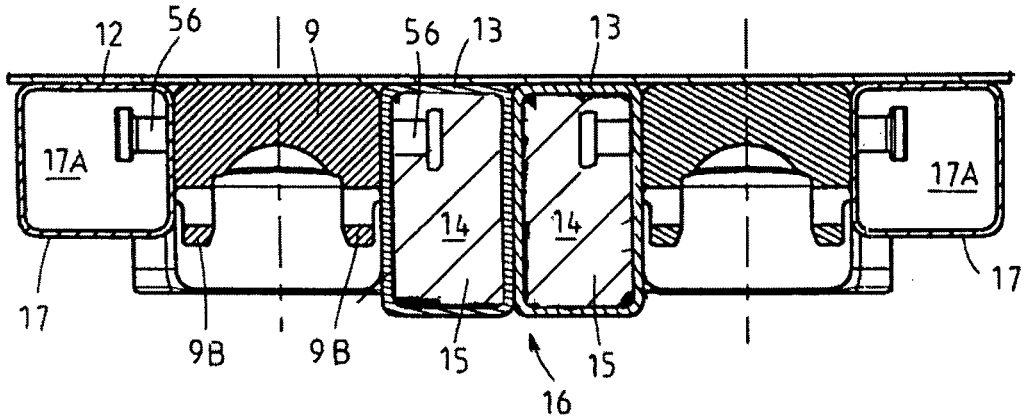
FIG. 7 shows a vertical section through the rear region of the shield canopy from FIG. 5.
Figure 8:
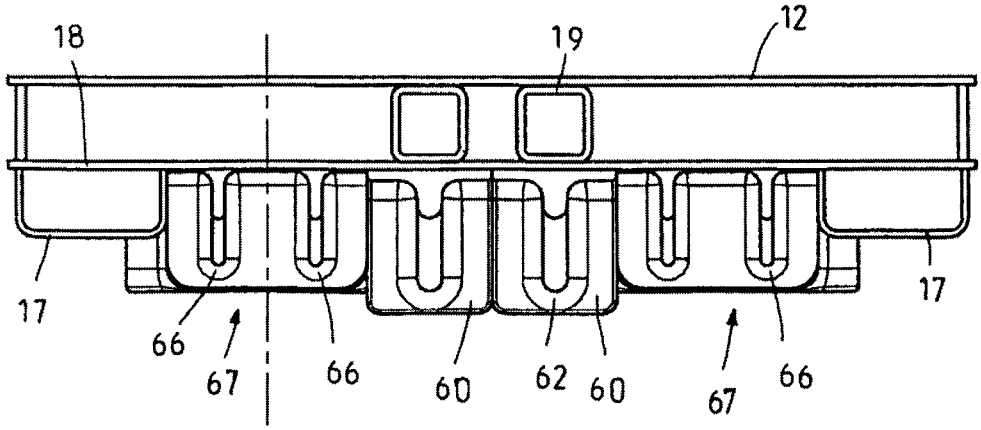
FIG. 8 shows a view of the shield canopy from FIG. 5 from the front.
Figure 5:
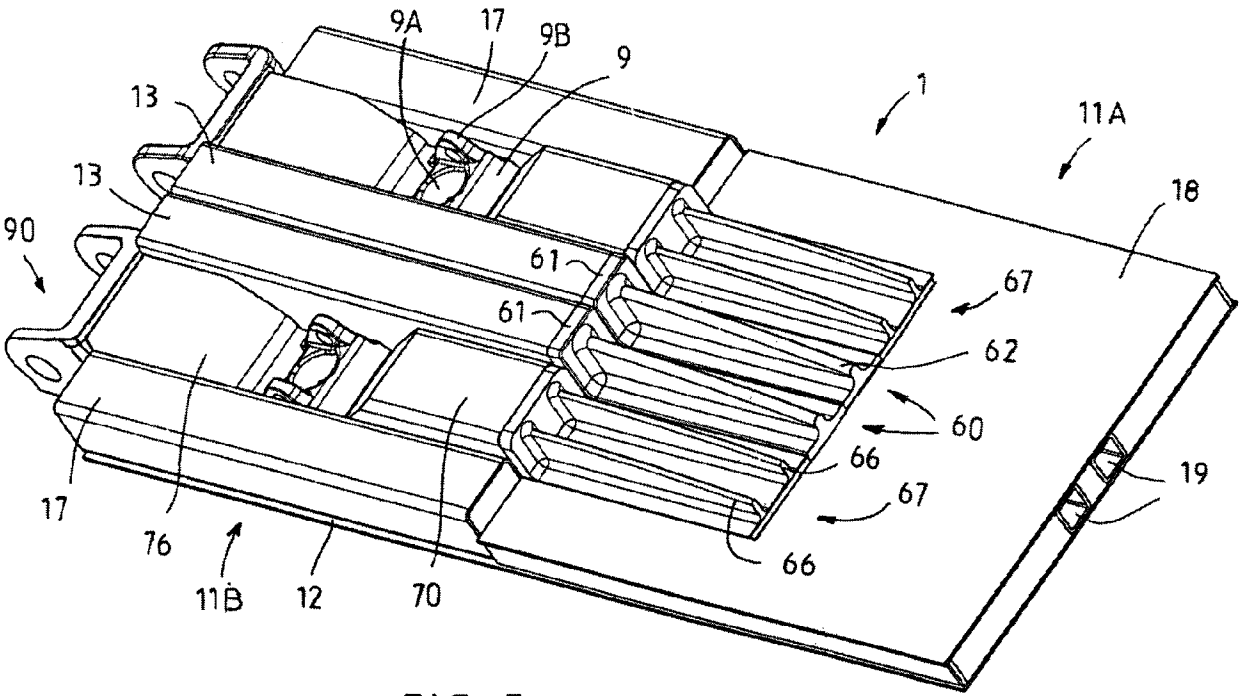
FIG. 5 shows in perspective the shield canopy of the shield support assembly from FIG. 1 in a view of its underside.

FIGS. 2 and 3 show a lower structure, designated in its entirety by reference number 40, for the shield support assembly 10 from FIG. 1 having two spaced-apart floor runners 20 situated next to one another. It can be clearly seen from the figures that both floor runners 20 each have as a central component a hollow metal box profile 22 with in this case a rectangular cross section and a dimension ratio of width B to height H of approximately B/H=5/3. The cavity 23 of both hollow metal box profiles 22 is filled over the entire length of the floor runners 20 with bound concrete 24 as solid, wherein a reinforcement 25 made up in this case of a plurality of rows of iron bars arranged eccentrically with a downward offset is additionally arranged in the concrete block 24 which fills the cavity 23. By filling the cavity 23 of the hollow metal box profiles 22 with the concrete 24, the compressive strength of the hollow box profile 22 is considerably increased by comparison with a non-filled hollow box profile even if the side walls of the hollow metal box profile 22 have a small wall thickness, and therefore, in spite of the thin wall thickness of the hollow metal box profile 22, both floor runners 20 can absorb all the bending forces which occur during operation, for example as a result of troughs or saddles in the floor or of rock fragments lying around.

The hollow metal box profile 22 of both floor runners 20 simultaneously forms, by way of its outer sides, the base and a constituent part of a welded construction 30 each having an outer side cheek 31 and an inner side cheek 32 which are welded to the transverse sides of the hollow metal box profile 22 and which comprise bearing eyes 33 and 34 in order to able to mount the lower ends of the links (5, 6 in FIG. 1) of the lemniscate mechanism 4 (FIG. 1) on the bearing cheeks 31, 32 of the welded construction 30. It can clearly be seen from the exploded representation in FIG. 3 that, prior to being welded to the hollow metal box profile 22 of a floor runner 20, the inner and outer bearing cheeks 31, 32 are connected via a connecting plate 35 to form a component assembly 36 for one floor runner 20 and to form a component assembly 37 of mirror-inverted design for the other floor runner 20. The component assemblies 36, 37 can therefore be prefabricated before they are welded to the hollow metal box profiles 22 of the floor runners 20. To obtain a particularly favourable welded connection between the transverse sides of the hollow metal box profiles 22 and the side cheeks 31, 32, the latter are provided with longitudinal slots 39 to which weld seams can be applied at the peripheral edge thereof. The two component assemblies 36, 37 can then, in the mounted state, be connected to one another via further intermediate plates 41 to which there can also be fastened an advancing cylinder or pushing cylinder in order optionally to push forward a winning machine or to advance a shield support assembly. In the exemplary embodiment shown, the two floor runners 20 are additionally connected to one another via a bridging strut 42 which is arranged on the front side of the two component assemblies 36, 37 and which is welded to the upper side of the hollow metal box profiles 22.

Also fastened to each floor runner 22 is a socket-like joint pan 8 in order to support the lower end of the hydraulic cylinders (7, FIG. 1) in an articulated manner in such a way that, depending on the distance between the floor runner and shield canopy, the hydraulic cylinder 7 can change its angular position. Each joint pan 8 has a trough-like depression 8A at its upper side in order to accommodate the lower end of the hydraulic cylinders. The socket-like joint pan 8 is represented in detail in FIG. 4 and is provided at its underside 45 with a strong, integrally cast anchor 46 having an anchor plate 47 whose diameter is larger than the diameter of a connecting stub 48 between the anchor plate 47 and underside 45 of the joint pan 8. The different diameters of the anchor plate 47 and the connecting stub 48 result in the anchor 46 having an undercut which, in the mounted state, can be filled with the filling material for the hollow metal box profiles 22, hence in this case with the concrete, in order if appropriate only to anchor the joint pan 8, in addition to a welded connection, on the floor runners 20.

For the purpose of embedding the anchor 46 in the filling material 24 which fills the cavity 23 in the hollow metal box profiles 22, the upper side of these profiles is provided, as shown in FIG. 3, with a respective, in this case circular, through opening 26 through which, as is schematically illustrated particularly in FIG. 1, the anchor 46 is inserted prior to introducing the concrete into the cavity 23. To improve the positioning accuracy, the joint pan 8 is fixed by means of weld spots prior to introducing the concrete (filling material) and/or connected to the reinforcement 25 arranged in the cavity 23 of the hollow metal box profiles 22.

In the exemplary embodiments shown, each floor runner 20 includes a single hollow metal box profile 22 to which all add-on parts are welded and, if appropriate, also screwed. As an alternative, each floor runner could also include two or more hollow metal box profiles filled with concrete and/or each floor runner consists of a multi-chamber hollow box profile of which only a few cavities are filled with concrete in order to achieve an optimum relationship between the overall weight and bending strength of the floor runners.

Reference will now be made to FIGS. 5 to 8 in which there is shown an exemplary embodiment of a shield canopy 10 which, as a load-bearing element for absorbing the bending forces exerted on the shield canopy 1, again comprises at least one hollow metal box profile 13 whose cavity 14 is filled with concrete and, if appropriate, a reinforcement. In the exemplary embodiment which is shown for the shield canopy 1, two separate hollow metal box profiles 13 are arranged directly on the underside of the canopy plate 12 symmetrically with respect to the centre longitudinal axis thereof and are filled with concrete 15 in the cavity 14, as illustrated in particular by the sectional representation in FIG. 7. The two hollow metal box profiles 13, which are arranged symmetrically with respect to the centre longitudinal axis of the shield canopy and at the same time centrally, form a central flange 16 for the shield canopy 1 that here extends, however, only over the rear length section 11B of the shield canopy 1 or the canopy plate 12. Arranged with a respective offset to the outer edge of the shield canopy, and with a spacing from the two concrete-filled hollow metal box profiles 13, are two further hollow metal box profiles 17 which, depending on the loading to be absorbed, could be either filled with concrete or some other solid or else, as empty hollow profiles, could be welded on only below the canopy plate 12. The outer hollow metal box profiles 17 also extend only over the rear length section 11B of the canopy plate 12 to approximately the centre of the shield canopy 1, and the two outer hollow metal box profiles 17 form lateral flanges for absorbing bending forces. The upper, again socket-like bearing pans 9, which are integrally provided on both sides of the depression pan 9A with eyes 9B to accommodate a fastening bolt, are in each case arranged between one of the hollow metal box profiles 13 forming the central flange and a hollow metal box profile 17 forming the lateral flange. The bearing pans 9 also include cast parts which here, however, have laterally projecting, undercut anchors 56 which engage through passage openings (not shown further) in the side walls of the hollow box profiles 13 and 17 and into the cavity 14 and 17A thereof in order to be positively anchored there in the filling material (concrete), as is indicated by way of example in FIG. 7 for the hollow metal box profiles 13 with the concrete block 15.

Figure 6:
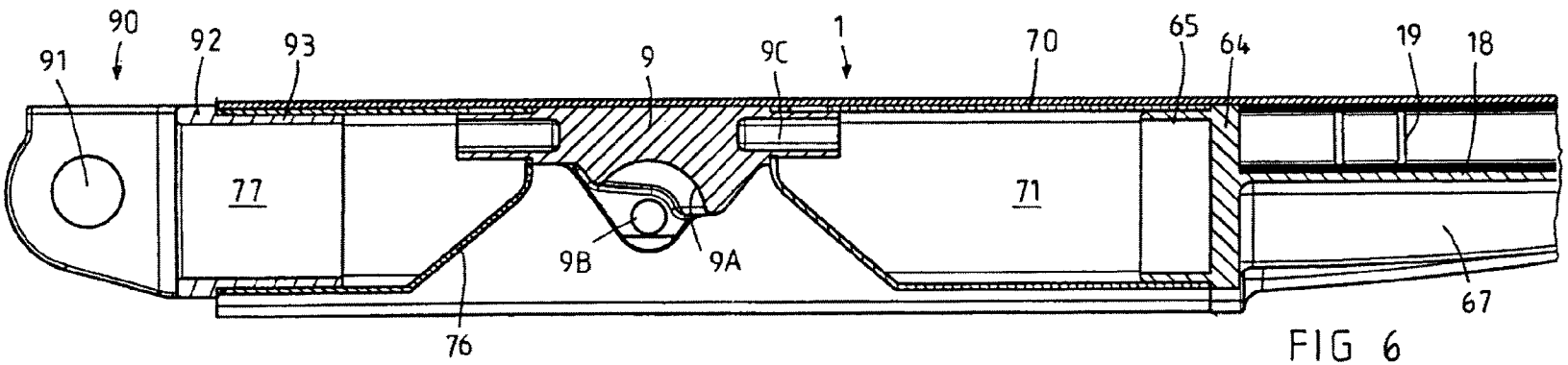
FIG. 6 shows an eccentric longitudinal section through the shield canopy from FIG. 5, partially cut away.

In order to achieve a high bending stiffness for the shield canopy 1 over its entire length even if the concrete-filled hollow metal box profiles 13 as central flanges and/or 17 as lateral flanges extend only over the half length section 11B of the canopy plate 12, supporting profiles 60 are inserted via a foot part 61 into both front ends of the hollow metal box profiles 13. Each supporting profile 60 has, starting from the foot part 61, a forwardly projecting supporting beam 62 with a substantially T-profile cross section in order to take up the forces acting on the front region 11A of the shield canopy 1 or the canopy plate 12 and also to channel these forces away into the filled hollow metal box profiles 13. Whereas the foot part 61 extends over the full height of the hollow metal box profiles 13 and is positively anchored in the cavity 14 preferably by means of a base part (not shown), the profile strut 62 of the supporting profile 60 has a smaller height in order that an intermediate plate 18 can be arranged below the canopy plate 12 in the front region 11A of the shield canopy 1, this intermediate plate imparting a high degree of bending stiffness to the front region 11A via a plurality of longitudinal and transverse struts 19. In order to support the front region 11A of the shield canopy 1 laterally as well, two further supporting profiles 67 are arranged on both sides of the central supporting profiles 60 and here include cast parts having two substantially T-profile struts 66 situated next to one another. As also shown in particular in FIG. 6, the two lateral supporting profiles 67 are again each provided with a foot part 64 which, projecting rearwardly, is provided with a base portion 65 which is centre of the shield canopy 1. The two hollow box elements 70 also have a cavity 71 which is filled with concrete or a mineral casting in order not only to increase the bending stiffness in the case of thin-walled hollow metal box elements 70 but at the same time also to achieve an anchoring of the supporting profiles 64 within the hollow metal box elements 70. Filling the hollow metal box elements 70 also enables the joint pan 9 to be additionally anchored if, as represented in FIG. 6, it engages into the cavity 71 by means of lugs 9*c*.

Between the bearing pans 9 and the rear edge of the shield canopy 1 are arranged further hollow metal box elements 76 which are formed in a similar manner to the hollow box elements 70. The cavity 77 of the rear hollow metal box elements 76 could also be filled with concrete. In a similar way to the front supporting profiles 67, joint brackets 90 with joint eyes 91 can be fastened to the rear end of the shield canopy 1 in order to connect the goaf shield (3, FIG. 1) to the joint eyes via the canopy joints (2, FIG. 1). The joint brackets 90, which again include cast parts, are provided with a foot part 92 comprising a base part 93 which projects rearwardly by way of a smaller rectangular cross section and whose outside diameter is positively inserted into the cavity 77 of the hollow metal box elements 76. If the cavity 77 is also filled with concrete, it is possible both for the strong bearing brackets 90 and the bearing pans 9 to be anchored to the hollow metal box elements 76 in an integrally bonded manner. However, the hollow metal box elements 70, 76 could, together with the canopy plate 12, the supporting profiles 60, 67 and the hollow metal box profiles 13, 17, also form a welded construction which is reinforced only partially, if at all, by a concrete filling or some other bound solid.

The foregoing description will reveal numerous modifications to a person skilled in the art which are intended to come within the scope of protection of the appended claims. As has already been described, it could also be possible in the case of the floor runners for a plurality of hollow metal box profiles to be connected to one another. In the case of the shield canopy, the central flange could consist of a single, concrete-filled hollow metal box profile. The two bearing pans could only be welded to the concrete-filled hollow metal box profiles and, if appropriate, to further components. The width/height ratio of the individual hollow metal box profiles may also differ from the exemplary embodiments shown. In the case of the shield canopy, the hollow metal box profiles could additionally be provided with a reinforcement composed of fibres, meshes or the like, it being possible in particular for the reinforcement to again include iron bars arranged eccentrically with respect to the neutral fibre or plane of the hollow metal box profiles. In the case of reinforced hollow metal box profiles, the concrete may also be introduced in layers in the form of different materials in order, in the region of the reinforcement, to achieve a filling with higher-grade concrete that can absorb higher tensile stresses than a lower-grade concrete in the other layers. The supporting profiles could also have other profile cross sections, such as, for example, a box profile, special profile, substantially I-profile, a substantially U-profile or the like.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. Shield support assembly for underground mining comprising:

a shield canopy and at least one floor runner as supporting surface elements which are connected in an articulated manner via a link mechanism and which can be pressed against rock by at least one hydraulic cylinder, the at least one hydraulic cylinder is supported in bearing pans on the shield canopy and floor runner, wherein each supporting surface element includes a welded construction of welded-together components, wherein at least one of the supporting surface elements includes, as a component of the welded construction, at least one hollow metal box profile filled with a solid.

2. Shield support assembly according to claim 1, wherein the hollow metal box profile has a substantially rectangular cross section whose cavity is filled with the solid.

3. Shield support assembly according to claim 2, wherein the solid consists of loose sand, loose granules or another loose, non-bound bulk material.

4. Shield support assembly according to claim 2, wherein the solid consists of concrete, of mineral casting or of bulk material which is bound by means of binders.

5. Shield support assembly according to claim 4, wherein one of connection joints for the link mechanism, joint sockets as bearing pans or transverse struts are partially anchored in the bound solid within the hollow metal box profile.

6. Shield support assembly according to claim 4, wherein at least one projecting, undercut anchor is formed on one of the connection joints or the joint sockets, the undercut anchor being inserted through an aperture in a profile wall of the hollow metal box profile into the cavity and being embedded fixedly against movement in the solid.

7. Shield support assembly according to claim 6, wherein a reinforcement comprising one of reinforcing bars, reinforcing cables, reinforcing fibres or reinforcing meshes is provided in the solid, wherein the reinforcement is arranged eccentrically.

8. Shield support assembly according to claim 7, wherein the anchor is directly connected to the reinforcement.

9. Shield support assembly according to claim 8, wherein the anchor and the reinforcement are one of screwed or welded together, or the anchor has at least one through opening for the reinforcement.

10. Shield support assembly according to claim 1, wherein the supporting surface element is designed as a floor runner, wherein the hollow metal box profile forms the bottom supporting surface by way of its underside.

11. Shield support assembly according to claim 10, wherein the hollow metal box profile is provided at its upper side with a through hole for the passage of an anchor formed at an underside of a joint socket which forms the bearing pan.

12. Shield support assembly according to claim 10, wherein component assemblies having joint eyes for the link mechanism are welded to the outer sides of the hollow metal box profile.

13. Shield support assembly according to claim 1, wherein at least one of the supporting surface elements comprises a welded construction comprising a plurality of hollow metal box profiles filled with the solid.

14. Shield support assembly according to claim 13, wherein the supporting surface element forms the shield canopy of a shield support assembly, wherein at least one solid-filled hollow metal box profile constituting a central flange is welded on below a canopy plate.

15. Shield support assembly according to claim 14, wherein a respective further solid-filled hollow metal box profile constituting a lateral flange is welded on below the canopy plate on both sides of the central flange.

16. Shield support assembly according to claim 15, wherein joint pans for accommodating the heads of the hydraulic cylinders have lateral anchors which engage through at least one of passage openings provided in the side walls of the central flange and passage openings provided in the side walls of the lateral flange into the cavity thereof.

17. Shield support assembly according to claim 16, wherein the central flange extends only over a rear length section of the shield canopy, wherein a supporting profile is welded on below the front length section of the canopy plate, this supporting profile having a foot part which is inserted into the hollow metal box profile and anchored in the solid.

18. Shield support assembly according to claim 16, wherein hollow metal box elements are arranged in front of and behind the joint pans, wherein supporting profiles are inserted by way of a foot part into the front ends of the front hollow metal box elements.

19. Shield support assembly according to claim 18, wherein connecting pieces having joint eyes for the link mechanism are fastened to the rear ends of the rear hollow metal box elements, wherein the connecting pieces have a foot part which is inserted into the hollow metal box element.

20. Supporting surface element for a shield support assembly for underground mining comprising:

a welded construction of welded-together components and at least one bearing pan for supporting a hydraulic cylinder which can be pressed against another supporting surface element, wherein at least one component of the welded construction includes a hollow metal box profile filled with a solid.

* * * * *